US009422068B2

(12) United States Patent
Ruefer

(10) Patent No.: US 9,422,068 B2
(45) Date of Patent: Aug. 23, 2016

(54) DRINKING WATER DELIVERY SYSTEM AND METHOD

(76) Inventor: Beda B.G. Ruefer, Bozeman, MT (US)

( * ) Notice: Subject to any disclaimer, the term of this patent is extended or adjusted under 35 U.S.C. 154(b) by 540 days.

(21) Appl. No.: 14/001,119

(22) PCT Filed: Feb. 22, 2012

(86) PCT No.: PCT/US2012/026150

§ 371 (c)(1),
(2), (4) Date: Mar. 10, 2014

(87) PCT Pub. No.: WO2012/121887

PCT Pub. Date: Sep. 13, 2012

(65) Prior Publication Data

US 2014/0174030 A1 Jun. 26, 2014

Related U.S. Application Data

(60) Provisional application No. 61/445,492, filed on Feb. 22, 2011.

(51) Int. Cl.

| | |
|---|---|
| ***E03B 3/04*** | (2006.01) |
| ***B65B 3/04*** | (2006.01) |
| ***E03B 3/36*** | (2006.01) |

(52) U.S. Cl.

CPC . *B65B 3/04* (2013.01); *E03B 3/04* (2013.01); *E03B 3/36* (2013.01)

(58) Field of Classification Search

CPC ..... E03B 1/00; E03B 1/02; E03B 1/04; E03B 1/048; E03B 3/04; E03B 3/32; E03B 3/36

USPC ..... 210/747.1, 747.5, 747.6, 170.01, 210/170.05, 170.09; 405/52, 127

See application file for complete search history.

(56) References Cited

U.S. PATENT DOCUMENTS

| | | | | |
|---|---|---|---|---|
| 4,507,206 | A | 3/1985 | Hughes | |
| 4,669,914 | A * | 6/1987 | Kortmann | E02B 3/00 405/52 |
| 4,724,086 | A * | 2/1988 | Kortmann | C02F 7/00 210/170.09 |
| 5,106,230 | A * | 4/1992 | Finley | E02B 1/003 405/52 |
| 5,392,806 | A * | 2/1995 | Gallant | E03B 3/04 137/236.1 |
| 5,549,828 | A * | 8/1996 | Ehrlich | C02F 7/00 210/170.09 |
| 7,222,638 | B1 * | 5/2007 | Wong | E03B 3/04 137/544 |
| 2005/0061721 | A1 * | 3/2005 | Tormaschy | C02F 7/00 210/170.05 |
| 2007/0039860 | A1 * | 2/2007 | Krock | C02F 1/441 210/170.01 |
| 2008/0011207 | A1 * | 1/2008 | Kryzak | C02F 1/004 111/100 |
| 2009/0175685 | A1 * | 7/2009 | Bowers | E02B 1/003 405/52 |
| 2010/0044290 | A1 * | 2/2010 | Hsu | C02F 1/004 210/170.09 |

OTHER PUBLICATIONS

International Search Report issued in PCT/US2012/026150 dated Oct. 31, 2012, 9 pages.

* cited by examiner

*Primary Examiner* — Christopher Upton
(74) *Attorney, Agent, or Firm* — Erise IP, P.A.

(57) ABSTRACT

Disclosed is a process for providing drinking water. First, a body of water is selected that has a geothermal floor creating a substantial range of depths where temperatures remain homogeneous, and an oxic to anoxic transition level at about 150 meters depth. Next, a conduit or other device is used to remove water from below the transition level. The removed water is then bottled or otherwise packaged for marketing.

12 Claims, 2 Drawing Sheets

112

DRINKING WATER DELIVERY SYSTEM AND METHOD

CROSS-REFERENCE TO RELATED APPLICATIONS

This application claims the benefit of U.S. Provisional Patent Application No. 61/445,492 filed Feb. 22, 2011, the entire contents of which are herein incorporated by reference.

BACKGROUND OF THE INVENTION

1. Field of the Invention

The invention relates generally to the field of providing drinking water.

2. Description of the Related Art

The extraction of water from bodies of water has been known for as long as the historic record allows. Some of these methods involve the extraction of water through conduits and filtration. U.S. Pat. No. 7,222,638 issued to Wong, et al. is an illustration of this sort of method. These kinds of prior art processes involve the use of a conduit which has one end inserted into the body of water, and another end used to receive the water into some form of containment for use. Also, there is normally a filtration or other purification subsystem located between the orifice in the body of water, and the end-use by the consumer. Some alternative methods of extraction use instead a vessel which is dipped into or submerged in the body of water and then is used to extract the water for use. One example, in U.S. Pat. No. 5,392,806 issued to Gallant, discloses a hybrid of the two already discussed methods.

It is also known to treat water removed from such a body in order to purify it or to remove harmful components adapting the water for a particular use. Also widely known, is that water can be bottled and marketed to consumers. Some versions of this market the water as being substantially pure, whereas in other products the water is presented as including minerals and other components.

SUMMARY

The disclosed embodiments include a method for supplying water where a body of water is selected. The body of water, in embodiments, has an oxic to anoxic transition level at a depth of about 150 meters. Further, the body of water has substantially homogeneous temperatures below the transition level, and these homogeneous temperatures are between a range of about 23° to about 24° Celsius, and more specifically, within the range of 23.3° to 23.5° Celsius in some embodiments.

In some embodiments, a conduit having a length greater than 150 meters is lowered down to a depth below the oxic to anoxic transition level, and is used to draw anoxic water to an above surface location. More specifically, the extraction point can be at just below the transition level. The water is then bottled, and in embodiments, indicia relating to the body of water is included on the bottle before delivering the water to market. In embodiments, the anoxic water is oxygenated before it is bottled. In further embodiments, the water is filtered before bottling.

In yet further embodiments, the anoxic water removed has Chloride levels at about 25.7 mg/L, Fluoride at about 0.934 mg/L, Sulfate at about 3.43 mg/L, and Arsenic, Lead, Mercury, Molybdenum, Nitrate as N, and Nitrite as N all at non-detectable levels. In some embodiments the total hardness for the anoxic water is about 201 mg/L expressed as equivalent of calcium carbonate. In some embodiments, the water has a PH level of about 8.3.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

Embodiments of the present invention provide systems and a method for extracting fossil water from a body of water, treating the water, including the water in a container, including indicia relating to the body of water on the container, and then distributing the water-filled container to a consumer.

Figure 1:
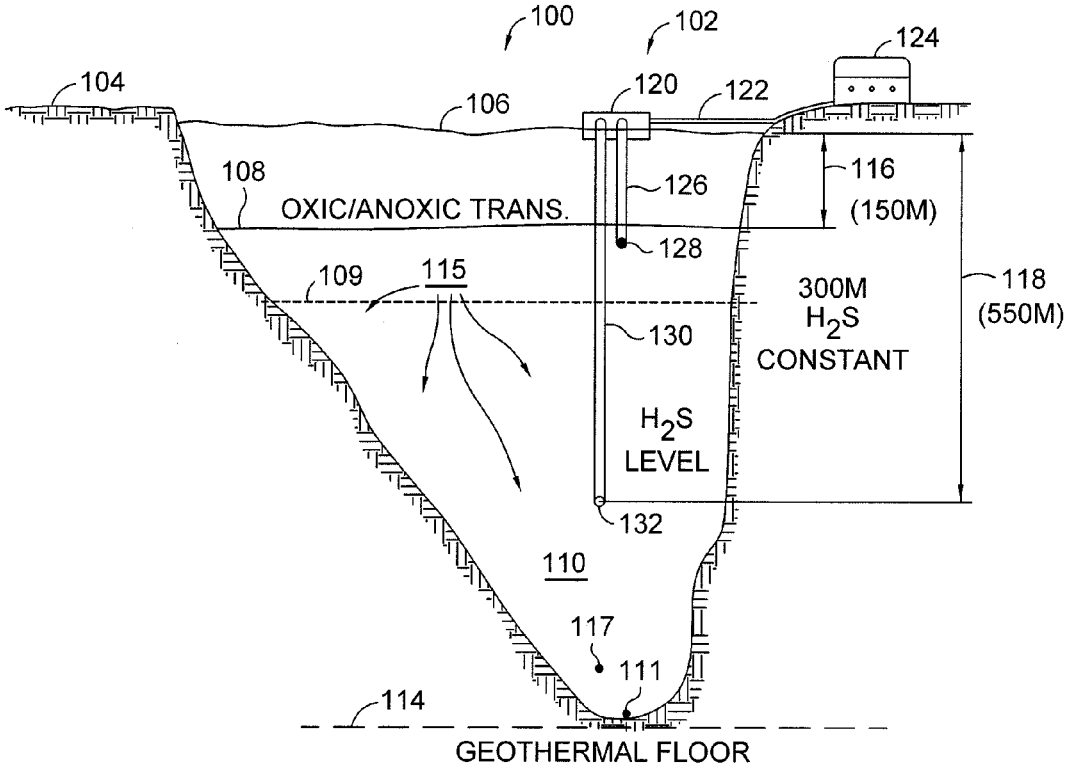
FIG. 1 is a cross-sectional view of a body of water selected and a water extraction which could be used in one embodiment.

FIG. 1 shows a body of water 100 which might be selected, and the systems 102 used for water extraction. As can be seen in the figure, a body of water 102 is surrounded by terrestrial areas 104. The body of water includes a surface 106. The processes disclosed herein involve, in embodiments, the selection of a particular body of water 100. In the preferred embodiment, the body of water will be a freshwater source having depth and other properties which result in the existence of an oxic to anoxic transition level 108. In more specific embodiments, this transition level might exist at about 150 meters (e.g., at some locations in Lake Tanganyika), which is only a fraction of the total depth of the lake. For example, in one embodiment, the body of water 100 has a maximum depth (at a level 114) of about 1500 meters (Lake Tanganyika), and may also possess a geothermal floor which influences water temperatures such that a very sizeable pocket 115 of substantially homogeneous temperatures is provided.

Figure 2:
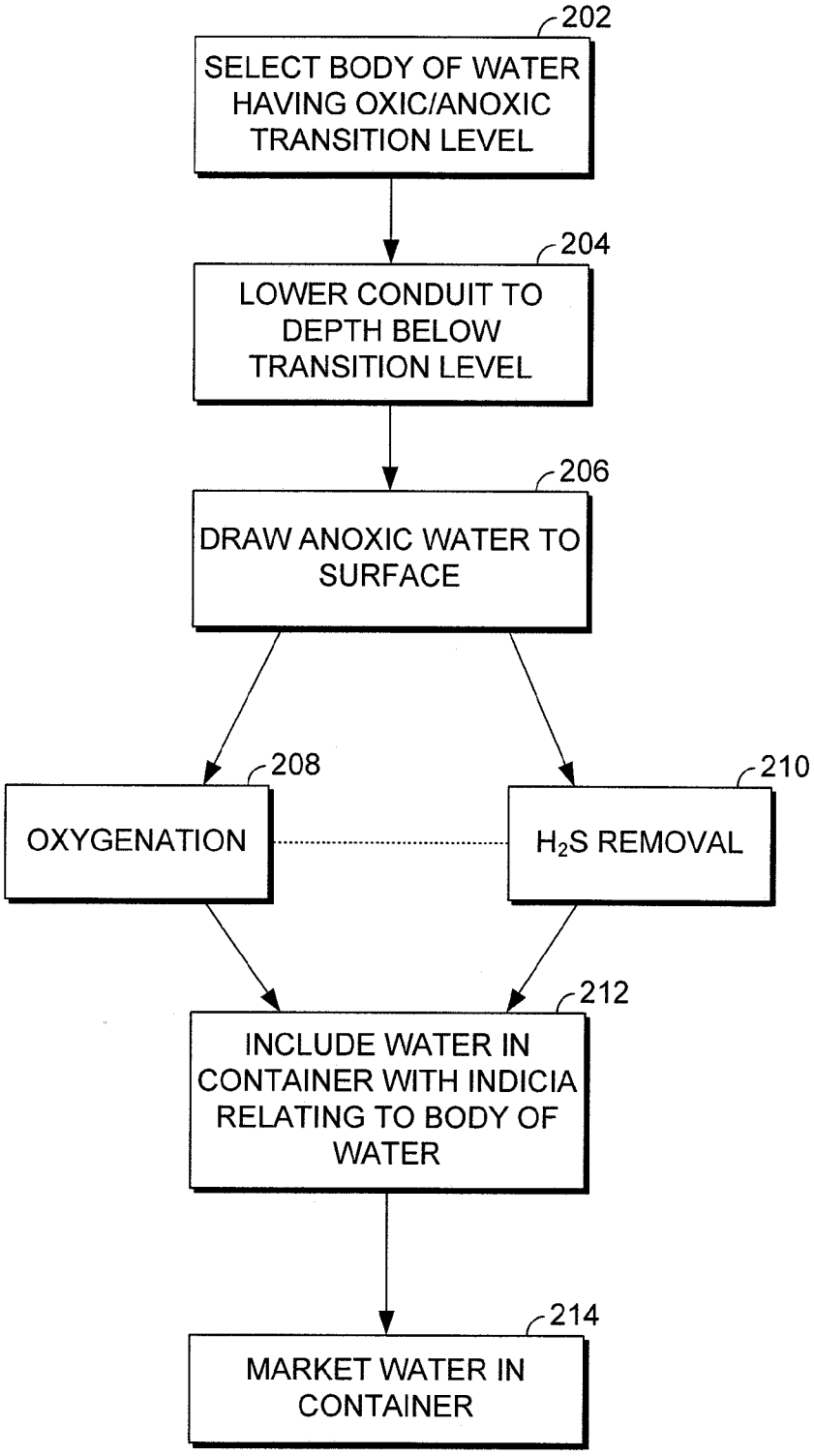
FIG. 2 shows a process flow diagram for an embodiment.

The step 202 of first selecting a body of water as a water source can be seen as part of the overall process 200 in FIG. 2. In this step, the lake selected should (i) have an oxic/anoxic transition line, e.g., line 108 in FIG. 1, and (ii) the transition line should not be so deep that it is difficult to reach. Also, the substantially homogeneous temperatures existing in the lake water at its depths below the transition line have created an abundance of what is commonly referred to as "fossil water." Fossil water does not ordinarily exist in abundance in the typical lake. This is because temperatures differentials between deep and more shallow levels in the lake will cause the upwelling of the deeper waters. These swells cause the lake waters to turn over. This eliminates the possibility of the lake maintaining densely packed fossil water.

In the execution of step 202, a special type of lake should be selected. Unlike the more typical lake where fossil water is not found, the lake selected in step 202 should include an abundance of fossil water. In one embodiment the lake selected is LakeTanganyika, which is the largest of the East African Rift Valley lakes. Lake Tanganyika has some unique properties which make it ideal for executing the methods of the present invention. For example, at levels below 150 feet the water temperatures remain within a very tight range—regardless of depth—of between 23° to 24° Celsius. More specifically, within a rather large pocket (which includes almost all of the lake below transition line 108) the temperatures are all substantially homogenous and stable, falling within a tighter range of between 23.3° to 23.5° Celsius. These highly homogeneous and stable temperatures eliminate the upwelling (discussed above) that exists in most other lakes. It is believed that the reason for these unusually homogeneous and stable temperatures is the existence of a geothermal floor 112 which exists underneath Lake Tanganyika. Although the precise reason for the unusually homogeneous temperatures is not known for certain, the precise temperature ranges discussed above have been measured.

Those familiar with the properties of lake Tanganyika will recognize that as one moves from zero depth at the surface 106, downward towards the oxic to anoxic transition line 108, the oxygen level in the water will become less and less because of the increase in water density. Then, at any depth below transition line 108, the water is completely anoxic.

Also, in the particular body of water selected, e.g., Lake Tanganyika, hydrogen sulfide levels in the water will be zero at all depths above transition line 108. But it has been recognized that the hydrogen sulfide levels gradually increase the deeper you go below the transition line until reaching a hydrogen sulfide saturation plateau depth 109. At all levels below plateau depth 109, the hydrogen sulfide levels remain constant all the way to the lowest point 111 in the lake. For example, a few meters below line 108 the hydrogen sulfide levels are relatively low, but at the plateau depth 109, the hydrogen sulfide levels are considerably higher—not dangerous in terms of a drinking water impurity—but could be detrimental to taste and smell in any drinking water product intended. The plateau depth 109 is about 300 meters in some embodiments (e.g., some locations in Lake Tanganyika).

Because the hydrogen sulfide levels increase downward from plateau depth 109, the systems used in some embodiments involve the extraction of water from just below the oxic/anoxic transition depth 108 in order to minimize the raw $H_2S$ content that need be removed. Also, less mechanical energy will be required to pump the anoxic water up to surface at the fossil water depth that is nearest the surface 106.

The systems 102 used for extraction can also be seen in FIG. 1. These systems may include some sort of floating or submerged or otherwise supported platform 120 or pier on the surface 106 of the water. Alternatively, a boat could be used. The platform 120 may or may not be fluidly connected via a pipe 122 to a refining/containment facility 124 (e.g., where the water will be put in containers). In some embodiments, a pump (not shown) on the platform is useful for drawing water from the depths. Extending down from the platform 120 is a first conduit 126. The top end of conduit 126, in embodiments, may be physically connected with a pump (not shown) on the platform which uses mechanical energy to withdraw water from the depths. At a lower end of first conduit 126 is an induction port 128 located just below the transition line 108. Alternatively, a siphon system can be used to draw the water up through conduit 126. In this arrangement, a bend at the upper end of conduit 126 would be created such that the exit mouth of the conduit releases the water into a containment vessel made to be lower than the bend. The containment vessel could be located on a barge (not shown) or some other separate vessel (e.g., boat) on the lake which would later transmit the contained water to shore.

This conduit 126, in a step 204 (see FIG. 2), can be lowered down into position in any number of known ways. As discussed in the last paragraph, this location (of port 128), in some embodiments, is an advantageous location to draw water from because although the water is completely anoxic fossil water, it also has relatively low hydrogen sulfide levels. This is because $H_2S$ gas reacts with dissolved oxygen found in the upper oxic region of the water forming non-toxic and odorless sulfates. This also makes the water intake location proximate the oxic/anoxic transition depth 108 desirable. A filtered sample composition extracted from point 128 in the lake (below the transition line 108) had the following components in the following amounts: Chloride 25.7 mg/L; Fluoride 0.934 mg/L; Sulfate 3.43 mg/L. Also in this sample, Arsenic, Lead, Mercury, Molybdenum, Nitrate as N, and Nitrite as N were not detected (not present). Total Dissolved Solids in the sample comprised 374 mg/L. Total permanent water hardness was measured at 201 mg/L expressed as equivalent of calcium carbonate (11.7 grains/US gallon). This total hardness value would be classify the water product as very hard, which is true for permanent hardness values over 180 mg/L of relative hardness.

In terms of acidity, the water extracted from point 128 has been found to have relatively high PH values. For example, the PH level for the sample discussed above had a value of about 8.3, which is significantly higher than most drinking water products being marketed. It has been determined that higher drinking water pH levels may be beneficial to human health, e.g., offsetting the acids from foods, mitigating potentially harmful stress-induced acidity in the stomach, and other benefits. And the basic water, in combination with the Calcium component, also help with bone development and maintenance.

The composition of the water extracted also has a sweet and otherwise satisfying taste lacking in alternatively produced water products. Additionally, other than simple filtration, the water extracted from point 128 is acceptable for drinking upon extraction. This greatly saves the treatment required upon extraction from other bodies of water, and extraction points.

In alternative processes, a deeper extraction point is enabled by the lowering (in step 204) of a longer conduit 130 which has an induction port 132 located in the depths of the lake. Water drawn from this point (in step 206) will be anoxic fossil water, and include relatively high levels of hydrogen sulfide. This may be advantageous for use in some non-drinking water applications. (Hydrogen sulfide is considered an undesirable component in drinking water or other consumables.) Also, ingredients in water extracted from port 132 might be higher in minerals or some other component desired from a drinking or industrial use standpoint.

It should be understood that although the extraction depths 128 and 132 are illustrated FIG. 1 embodiment, and discussed in detail, it is still within the spirit and scope of this invention to extract from numerous other depths as well. Ordinarily, the depth selected will depend on the composition available at a particular depth, and the application the water is being sought for. Thus, the extraction made in step 206 (see FIG. 2 process flow) can be made from a vast variety of depths below the oxic/anoxic transition level 108.

After the extraction step 204, the process splits into two simultaneously and/or separately executed refining steps. These steps (206 and 208) may be conducted at the platform immediately upon extraction. Alternatively, steps 206 and 208 may be preceded by the extracted water being delivered to land through pipe 122 to a refining/containment facility 124. Regardless, in step 206, the anoxic water is oxygenated. In another step 208, the hydrogen sulfide is either completely removed from, or minimized in the water. One way in which steps 206 and 208 might occur concurrently is if the oxygenation (e.g., through aeration) is allowed to effervesce to the atmosphere. In such a case, the hydrogen sulfide will leave as a natural effluent. This is because when the unrefined water is drawn to the surface, the depth-created density that caused the $H_2S$ gas to remain in the fossil water no longer exists. As discussed above, it is known that H2S gas reacts with dissolved oxygen found in the upper oxic region of the water forming non-toxic and odorless sulfates. Thus, the $H_2S$ naturally leaves the water upon oxygen exposure.

Alternatively, for embodiments where the hydrogen sulfide is desirable for some reason, the water would have to be maintained under pressure, and the oxygenation process would be made by alternative means.

It is also possible that the hydrogen sulfide removal in step 210 would be accomplished using charcoal filtering.

It should be understood that both of steps 208 and 210 are, in some instances, optional, and that for many applications the water product can pass on to the rest of the FIG. 2 steps (directly from step 206) without the step 208 oxygenation and the step 210 hydrogen-sulfide-removal refinements being made.

Further, steps 208 and 210 are not intended to be a complete list of all the processing steps engaged in. For example, it is also contemplated that steps be taken to manipulate and or adjust the PH levels in the water to make it more suitable for human consumption. And although many of the minerals contained in the water may be desirable depending on the particular application intended (e.g., drinking water, cosmetics ingredients), other minerals and raw components may have to be removed before bottling and/or marketing. Thus, the lack of description describing these additional steps should not be considered limiting.

In a next step 212, which will likely be preceded by the extracted water being delivered to land through pipe 122 to containment facility 124, the water (refined or unrefined) will be placed in a container of some sort. If the product is left unrefined, it might be included in relatively large containers (e.g., drums) and exported to a remote refining location. Alternatively, the product might be fully refined on site (in the refining/containing facility 124) and included in smaller containers intended for consumption by consumers either locally, or exported to other regions.

Regardless of the containment means selected, the container can also in step 212 be labeled with indicia relating to the particular body of water it was derived from. For example, some statement or trade reference could be made on the container regarding "Lake Tanganyika" or a variation of that name. It could also reference some other geographic reference to something close to or on the lake, e.g., "Tanzania" or even a sound-alike word or phrase that makes the geographic link, but is not an actual geographic reference, e.g., "Tanzamaji."

In a next step 214, the water product is marketed in its container. This marketing could take the form of distributing to wholesalers, retail outlets, or directly to consumers. In many instances, it will be desirable to include references to the water's origin (e.g., Lake Tanganyika) considering the desirable properties exhibited by the fossil water derived from the particular body of water.

The water product is useful as a nutrient rich drinking water, or could be included as an enhancing ingredient in other more complex products, e.g., isotonic drinks, various foods and beverages, cosmetics, and numerous other applications.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

The invention claimed is:

1. A method for supplying water, the method comprising:
selecting a body of water, the body of water having a maximum depth;
the body of water having an oxic to anoxic transition level at a depth of about 150 meters;
the body of water also having substantially homogeneous temperatures below the transition level, the homogeneous temperatures normally existing between a range of about 23° to about 24° Celsius;
providing a conduit having a length greater than 150 meters;
lowering the conduit into the body of water to a depth below the oxic to anoxic transition level in the body of water;
drawing anoxic water from the position up through the conduit to an above surface location;
including an extracted quantity of the water in a container;
labeling the container with indicia relating to the body of water; and
delivering the water to a consumer.

2. The method of claim 1 wherein the temperature range is 23.3° to 23.5° Celsius.

3. The method of claim 1 comprising:
oxygenating the anoxic water after the drawing step but before the including step.

4. The method of claim 1 comprising:
either removing or minimizing a hydrogen sulfide level in the water after the drawing step but before the including step.

5. The method of claim 1 wherein the body of water is Lake Tanganyika.

6. The method of claim 1 wherein the drawing step is executed by pumping.

7. The method of claim 1 wherein the drawing step is executed by siphoning.

8. The method of claim 1 wherein the drawing step further comprises filtering the anoxic water but otherwise maintaining the anoxic water at a composition including Chloride at about 25.7 mg/L, Fluoride at about 0.934 mg/L, Sulfate at about 3.43 mg/L, and Arsenic, Lead, Mercury, Molybdenum, Nitrate as N, and Nitrite as N all at minimal levels.

9. The method of claim 1 wherein the total hardness for the anoxic water is maintained at a same hardness level when bottled as it existed at when still in the body of water, the level being about 201 mg/L expressed as equivalent of calcium carbonate.

10. The method of claim 1 wherein a PH level of the anoxic water is maintained at the same PH level at which the anoxic water existed at while still in the body of water, the PH level being about 8.3.

11. The method of claim 1 wherein the lowering step further comprises positioning and induction point at just below the oxic to anoxic transition level.

12. A method for producing drinking water, the method comprising:

selecting a body of water, the body of water having an oxic to anoxic transition level at a depth of about 150 meters;

the body of water also having substantially homogeneous temperatures below the transition level, the homogeneous temperatures normally existing between a range of about 23° to about 24° Celsius;

removing anoxic water from a depth below the oxic to anoxic transition level and bringing the anoxic water to an above surface location; and including an extracted quantity of the water in a container while maintaining: (i) a Chloride level at about 25.7 mg/L; (ii) a Fluoride level at about 0.934 mg/L; (iii) a Sulfate level at about 3.43 mg/L; (iv) a total hardness level of about 201 mg/L expressed as equivalent of calcium carbonate; and (v) a PH level of about 8.3.

* * * * *